US005480257A

United States Patent [19]

Allen

[11] Patent Number: 5,480,257

[45] Date of Patent: Jan. 2, 1996

[54] CONCRETE RIDING TROWEL GUARD CLEARANCE SYSTEM

[75] Inventor: J. Dewayne Allen, Paragould, Ark.

[73] Assignee: Allen Engineering Inc., Paragould, Ark.

[21] Appl. No.: 170,512

[22] Filed: Dec. 21, 1993

[51] Int. Cl.[6] ..... F01C 19/00; F01C 19/22

[52] U.S. Cl. ..... 404/112

[58] Field of Search ..... 404/96, 97, 112

[56] References Cited

U.S. PATENT DOCUMENTS

| | | | |
|---|---|---|---|
| D. 323,510 | 1/1992 | Allen | D15/10 |
| 3,936,212 | 2/1976 | Holz | 404/112 |
| 4,027,991 | 6/1977 | Maass | 404/112 |
| 4,046,484 | 9/1977 | Holz | 404/112 |
| 4,577,993 | 3/1986 | Allen | 404/112 |
| 4,920,698 | 5/1990 | Friese et al. | 49/125 X |
| 5,108,220 | 4/1992 | Allen | 404/112 |

*Primary Examiner*—William P. Neuder
*Attorney, Agent, or Firm*—Stephen D. Carver; Trent C. Keisling

[57] ABSTRACT

A guard clearance system for motorized riding trowels adapted to allow finishing of a slab surface immediately adjacent an obstacle. The system comprises a movable arc of trowel guard cage displaceably coupled to an end of the trowel guard cage and spaced apart buffer wheels mounted to the cage. The arc is displaceable between a deployed position generally aligned with a lower ring of the cage and a retracted position. When retracted an unguarded segment of the trowel rotor sweep is established, allowing the finishing blades to be deployed immediately adjacent a wall or other obstacle. A displaceable coupling for moving the arc between the deployed position and the retracted position extends from the cage to the arc. In a mechanical embodiment the displaceable coupling is a pair of slidably adjustable brackets extending from the arc to the cage. The displaceable coupling may comprise electromechanical elements for displacing the arc between deployed and retracted positions. Semitubular cradles extend from the cage to mate with the arc when it is deployed. The buffer wheels contact the wall and allow forward and rearward movement of the trowel along the wall while finishing the slab immediately adjacent the wall. The wheels are adjustable inwardly and outwardly to compensate for varying widths of finishing implements employed by the trowel.

13 Claims, 7 Drawing Sheets

CONCRETE RIDING TROWEL GUARD CLEARANCE SYSTEM

BACKGROUND OF THE INVENTION

I. Field of the Invention

The present invention relates generally to motorized concrete finishing machines. More particularly, the present invention relates to a guard clearance system for motorized riding trowels that will maintain the trowel in a spaced apart relationship with a wall (or other obstacle) while allowing finishing of a slab surface immediately adjacent the wall. Known self propelled riding trowels are classified in United States Class 404, Subclass 112.

II. Description of the Prior Art

As will be recognized by those skilled in the art, it is well known that wet concrete must be appropriately finished. Motorized trowels are well known as machines for finishing wet concrete. Generally, motorized trowels come in two configurations, riding and manually manipulated. Each type of trowel employs finishing blades that rest directly on the concrete surface to be finished and that support the machine's entire weight. A wide variety of manually pushed troweling machines have previously been proposed. However, self propelled riding trowels are preferred because they finish the concrete quicker and more efficiently. Motorized trowels generally employ pivoting blades. The trowel is passed over the concrete surface several times as the concrete sets. The pitch of the blades is adjusted for each pass.

Riding trowels generally include some form of frame from which two or more rotors downwardly project. Each rotor has three or four horizontally oriented, symmetrically disposed blades. The rotors are propelled by a self contained motor mounted on the frame that may be linked to rotor gear boxes. A yoke controlled bearing assembly is often employed to vary blade pitch. The weight of the trowel and the operator is transmitted frictionally to the concrete by the revolving blades. The operator sits on top of the frame and controls the movement of the trowel through a steering system. Steering is accomplished by tilting the blade assemblies to generate differential vector forces. The forces propel the frame across the concrete.

The present assignee, Allen Engineering, owns several prior motorized trowels and related improvements that may be considered relevant to the present invention. U.S. Pat. No. 4,577,993 issued on Mar. 25, 1986, discloses a power trowel with a cam actuated blade pitch adjustment mechanism. Another patent issued to Allen is U.S. Pat. No. 5,108,220 which is directed to a fast steering system for riding trowels. U. S. Des. Pat. D. 323,510 also discloses a riding trowel. The latter two patents each disclose, in detail, a guard system typical of those employed on riding trowels.

Riding trowels typical of those present in the art are disclosed in two patents issued to Holz, U.S. Pat. Nos. 4,046,484 and 3,936,212. '212 is a three rotor riding trowel while '484 is a more popular two rotor trowel. Each of the rotors in the Holz patents has three radially spaced apart blades. The blades are guarded by stationary outer rings and inwardly projecting frame members. In the '212 reference, inner rings are also employed to guard the blades.

Guard cages such as those disclosed in the above referenced patents are necessary to protect workers from the rotating blades and to protect the blades from striking rigid structures which could damage the blades. For example, it is more desirable for the cage to strike an obstruction, such as a column, than the blades. This prevents damage to the blades and the motor of the trowel. However, the use of such a guard cage makes finishing surfaces near obstructions and walls difficult.

Maass, U.S. Pat. No. 4,027,991, assigned to M-B-W, Inc., discloses a manually pushed power trowel with a retractable guard ring section. This section when retracted can bear on a wall to prevent contact between the blades and the wall.

In the past riding trowels failed to provide sufficient control to finish tight areas, such as a slab near the base of a wall. Therefore, it was unnecessary to provide a method for using riding trowels immediately adjacent walls or other structures. The advent of more easily controllable riding trowels, such as the trowel disclosed in aforementioned U.S. Pat. No. 5,108,220, renders the finishing of tight areas using a riding trowel more practical.

Hence, it is desirous to provide an improved guard clearance system for motorized riding trowels. Such a system would provide a portion of trowel guard that would move to a retracted position, exposing a segment of the finishing blade sweep. This exposed segment would then be maneuvered into close proximity with an obstacle, such as a column, curb or wall, to finish the concrete adjacent the obstacle. The displaceable coupling between the retractable portion of the guard and the trowel is either manually or electromechanically manipulated. The guard clearance system should also employ a buffer system to allow the trowel to contact a wall and move along the wall. Such a buffer system would facilitate finishing adjacent to the wall while still protecting the blades by preventing contact with the wall.

SUMMARY OF THE INVENTION

My guard clearance system for motorized riding trowels is a movable section or arc of trowel guard attached to the fixed guard cage of a trowel by a displaceable coupling. When deployed, the arc is disposed on the end of the trowel, at the base of the guard cage, aligned with the lowermost ring of the guard cage. The arc rests in a pair of cradles extending from the lower ring of the guard cage. When the arc is retracted, an unguarded segment of the blade's sweep is exposed. This unguarded segment may be deployed immediately adjacent an obstacle to facilitate finishing.

The operator can maneuver the riding trowel to dispose this segment near obstacles such as columns, curbs and walls. My system further comprises a set of buffer wheels. These buffer wheels are positioned on the stationary portion of the guard to contact a wall. They allow the trowel to move along the wall and finish the surface immediately adjacent the wall. The buffer wheels keep the trowel away from the wall, thereby avoiding contact between the blades and the wall.

The axles of the buffer wheels are adjustable inwardly and outwardly in the housings mounting them to the cage. Adjustability is necessary to accommodate various finishing elements. For example, variable width riding trowels sometimes employ pans mounted on the rotor blades. These pans have a greater overall diameter than conventional blades. A further alternative embodiment of my system calls for the buffer wheels to be adjusted by interconnected powered, electromechanical systems.

The displaceable coupling may be a manual system requiring physical manipulation by an individual or a powered, electromechanical system actuated by the operator. The manual coupling comprises a pair of spaced apart brackets. The brackets extend between the arc and a frame header. Bolts pass through slots defined in the brackets and are threaded into the header. Adjustment of the arc is made by loosening the bolts and sliding the brackets inwardly or outwardly. The header spans two spokes of the frame cage, reinforcing the cage. A crossmember extends between the brackets to provide rigidity.

Three power operated electromechanical displaceable coupling systems are proposed. In the first, an electrical screw jack, interconnected between the header and the crossmember, allows extension and retraction of the arc. Brads replace the bolts retaining the brackets to the header. The brads allow the brackets to slide. The cradles and the end of the slots or the crossmember act as a stop at either end of travel.

A second electromechanical operating system employs a hydraulic or pneumatic cylinder, or some other type of reciprocating device, such as an electrical solenoid. The brackets described above are replaced by hinged brackets extending between the header and the arc. The reciprocating coupling extends between the crossmember and the header. As the coupling is retracted or deployed, the arc rotates about the bracket hinges.

The third electromechanical system employs a pair of brackets extending from the arc into the frame of the trowel. A crosspiece of the trowel frame or cage mounts a pair of guides which index with the slots in the brackets. The arc is retracted and deployed linearly along the guides by a reciprocating device such as a hydraulic/pneumatic cylinder or a solenoid. The reciprocating device is pivotally mounted between a second, upper crossmember and the crosspiece. The cradles of the third electromechanical embodiment are abbreviated so that the cradle will receive the arc as it lineally approaches.

To retract or deploy the mechanical embodiment the trowel must be stopped. The bolts retaining the brackets in place are loosened and the arc then slid upwardly with the loosened bolts guiding the slots. The bolts are retightened to hold the arc in the retracted position. The trowel is then restarted and the concrete adjacent the obstacle is finished. If the obstacle is a wall, the buffer wheels are utilized to allow the trowel to be driven along the wall without the blades contacting the wall. To redeploy the arc, the trowel is stopped and the bolts are loosened. The arc is then slid down to contact the cradles and the bolts are retightened.

In the electromechanical embodiments the trowel does not need to be stopped to adjust the arc and buffer wheels. They are adjusted as necessary though operator controllable switches. Therefore, the use of electromechanical devices to retract the arc and to adjust the buffer wheels results in significant savings in both time and labor costs.

Thus, a fundamental object of the present invention is to provide a guard clearance system for riding trowels to facilitate finishing of concrete immediately adjacent obstacles by a riding trowel.

Another object of the present invention is to provide a clearance system that will maintain a riding trowel in a spaced apart relationship with a wall while allowing finishing of the slab.

A more specific object is to provide a clearance system for a multiple rotor riding trowels.

Another object is to simplify concrete finishing operations by reducing the hand work required to finish a slab.

A basic object is to provide an economical manual system in conformance with the present disclosure.

Another object is to provide an electromechanically actuated guard clearance system which can easily be controlled by the operator.

A related object is to provide an electromechanically actuated clearance system that economizes the time required to finish a concrete slab.

A further object is to provide a clearance system and riding trowel of the character described that provides maximum safety while allowing finishing immediately adjacent obstacles.

A related object of the present invention is to provide a buffer wheel system to prevent inadvertent contact between the blades of a riding trowel and a wall.

A related object is to provide a greater degree of consistency in a finished slab surface by allowing a riding trowel to finish a greater portion of the concrete surface.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
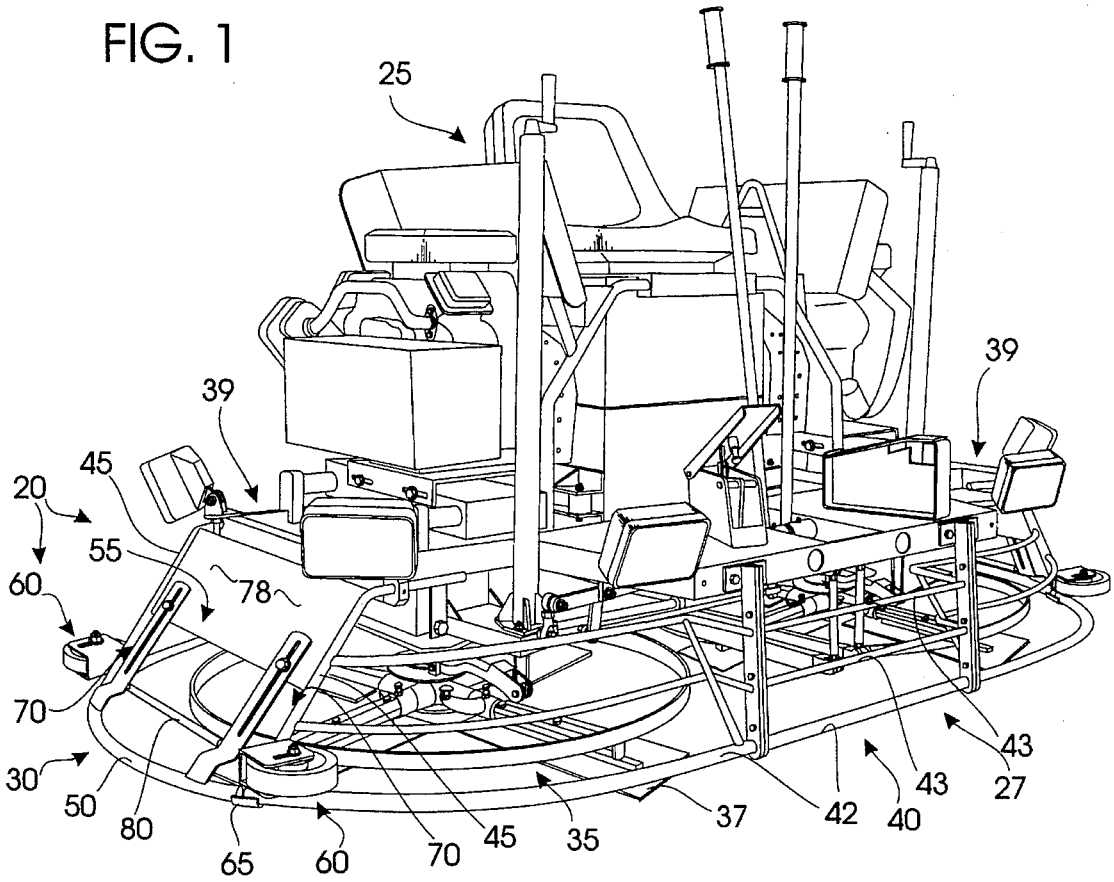
FIG. 1 is a front isometric view of a riding trowel mounting my guard clearance system, with the arc deployed.

Turning now to the drawings, the manual embodiment of my riding trowel guard clearance system is broadly designated by the reference numeral 20 in FIGS. 1 through 8. Powered electromechanical embodiments of my system 20A, 20B and 20C are illustrated in FIGS. 9 through 14.

All riding trowels 25 have some common characteristics. They generally have a front 27 defined as the direction faced by an operator, an opposite rear 29 and spaced apart ends or sides 30. Riding trowels 25 generally employ two or more rotors 35 having radially spaced apart concrete finishing blades 37. The rotors 35 are rotated at high speed to finish concrete. The pitch of the blades 37 may be varied depending on the cured condition of the concrete and the finish desired.

Riding trowels 25 employ a guard cage 40 to prevent inadvertent contact between the rotor 35 and workers or obstacles. The cage 40 is generally secured to a frame 39 associated with the trowel 25. The cage 40 is comprised of a lower ring 42 and one or more spaced apart upper rings 43. Spokes 45 generally extend perpendicularly to the rings 42 and 43, providing rigidity to the cage. The guard cage 40 disposed about the riding trowel 25 is generally oval shaped. The front 27 and rear 29 of the guard cage 40 of a riding trowel is generally flat, and the ends 30 are curved.

Trowel structural details including frame construction, power train design, rotary blade suspension, motor control, steering linkages and the like are disclosed in U.S. Pat. Nos. 4,577,993, 5,108,220, 4,046,484 and 3,936,212. These patents are hereby incorporated by reference for purposes of disclosure.

Guard cages 40 such as those disclosed in the above referenced patents are necessary to protect workers from the rotating blades 37 and to protect the blades 37 from striking rigid structures which could damage the blades. For example, it is more desirable for the cage 40 to strike an obstruction, such as a column or wall, than the blades 37. This prevents damage to the blades 37 and the trowel motor. However, the use of such a guard cage 40 makes finishing surfaces near obstructions and walls difficult.

My clearance system 20 allows a motorized riding trowel 25 to finish a slab surface 44 immediately adjacent an obstacle such as a wall 46, column or curb. When used to finish a slab 44 adjacent a wall 46, the present clearance system 20 is adapted to maintain the trowel 25 in a spaced apart relationship with the wall 46 while allowing finishing of the slab 44 surface immediately adjacent the wall 46 (FIGS. 5 through 8). The system 20 is comprised of a movable arc 50 of trowel guard cage ring 42 coupled to the cage 40 or trowel frame 39 by a displaceable coupling 55. Buffer wheels 60 are mounted to the cage 40 of the trowel 25 for contacting a wall 46, allowing movement of the trowel 25 along the wall 46.

Figure 6:
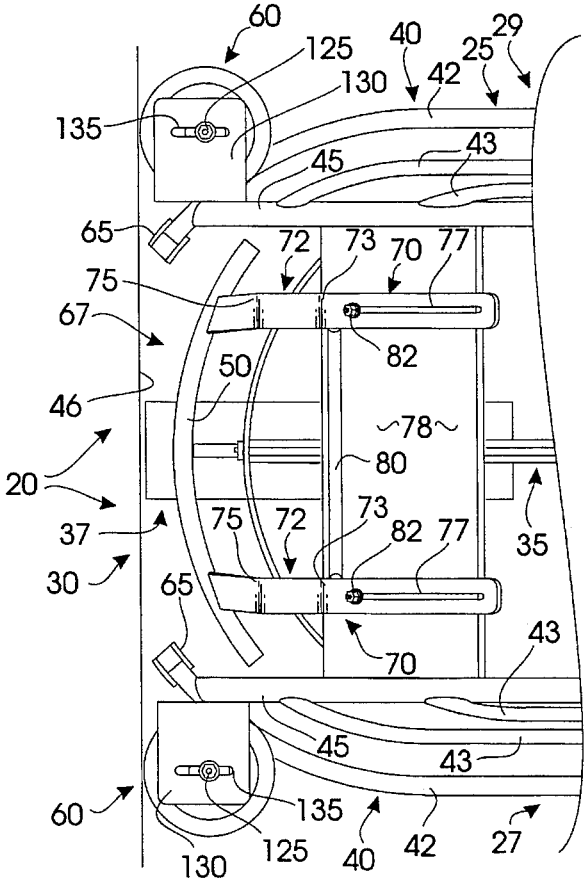
FIG. 6 is a fragmented top plan, environmental view of the manual embodiment of my clearance system with the arc retracted and the buffer wheels contacting a wall.
Figure 7:
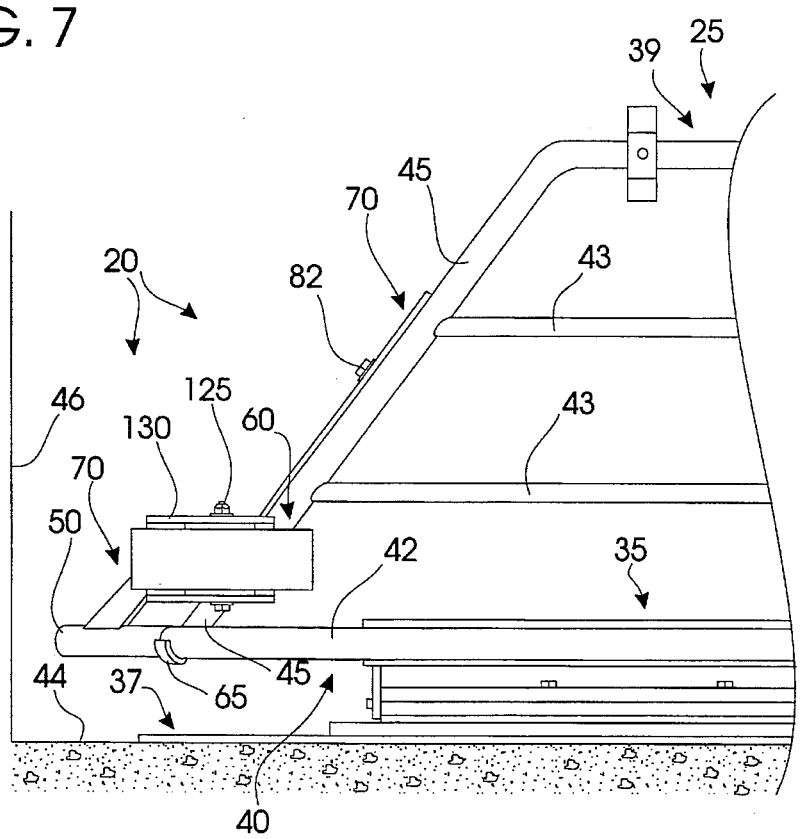
FIG. 7 is a fragmented front elevational, environmental view of the manual embodiment of my clearance system with the arc deployed.
Figure 8:
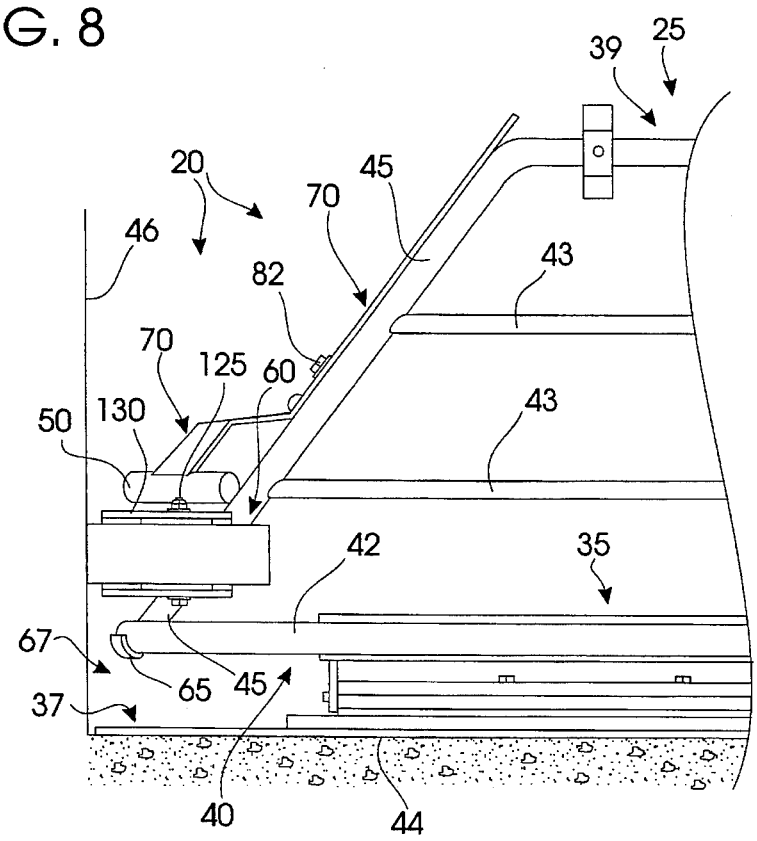
FIG. 8 is a fragmented front elevational, environmental view of the manual embodiment of my clearance system with the arc retracted and the buffer wheels contacting a wall.
Figure 9:
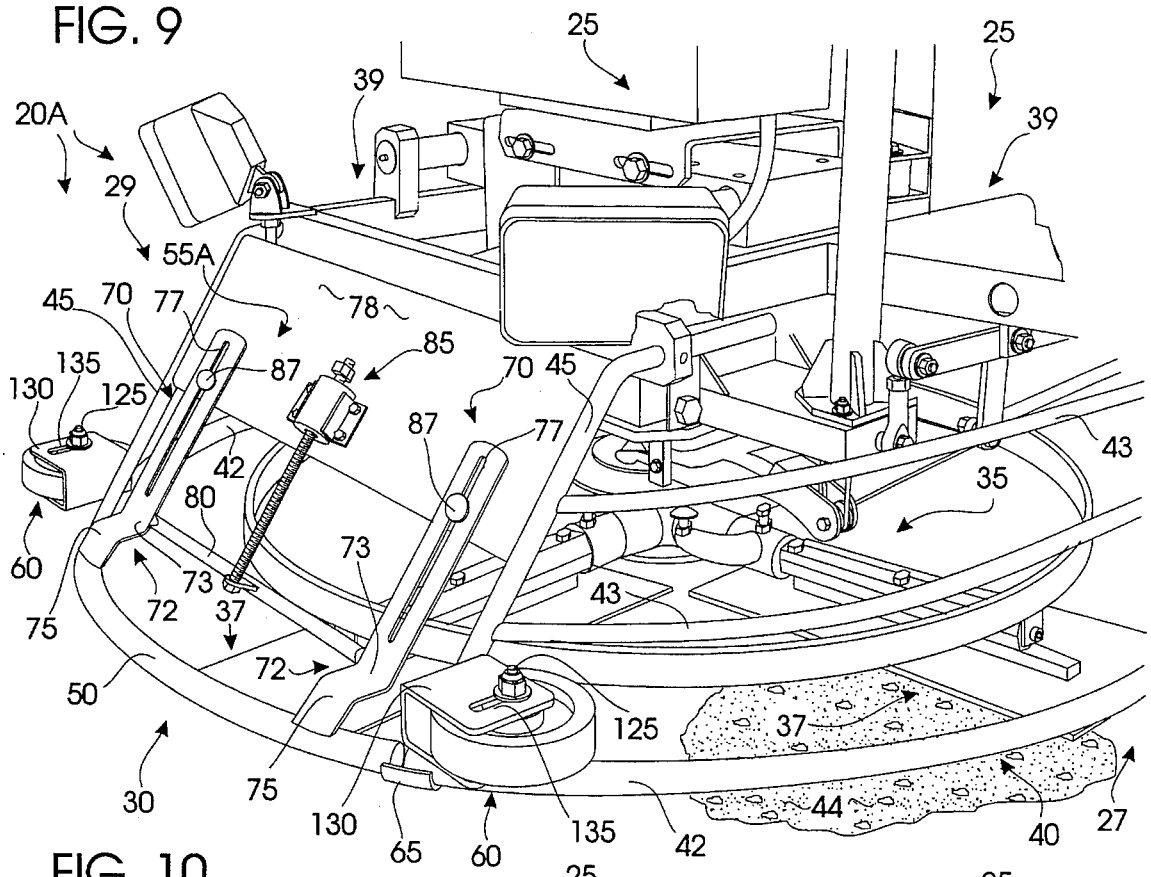
FIG. 9 is a partially fragmented front isometric view of the first electromechanical embodiment of my clearance system with the arc deployed.

The cage 40 and movable arc 50 are preferably constructed of round tubing. The arc 50 is a separate piece of trowel guard cage ring 42 disposed at the base of the guard cage 40 on an end 30 of the trowel 25. When deployed, the arc 50 is aligned with the lower ring 42. The arc 50 rests in a pair of cradles 65 extending from the trowel cage's lower ring 42. The cradles 65 are semitubular, having an internal diameter sufficient to receive the external diameter of the arc's tubing. The arc 50 may be disposed in either a deployed position, wherein it rests in the cradles 65 and is generally aligned with the lower ring 42 of the cage 40 (FIG. 3), or in a retracted position. When the arc 50 is in the retracted position, an unguarded segment 67 of the rotor blades's sweep is exposed. This unguarded segment 67 may be deployed immediately adjacent an obstacle to facilitate finishing (FIG. 6). The cradles 65 act to reinforce the arc 50 when it is deployed. A blow to the end 30 of the trowel will be transferred through the cradles 65 to the cage 40 and not be entirely absorbed by the coupling system 55.

Figure 4:
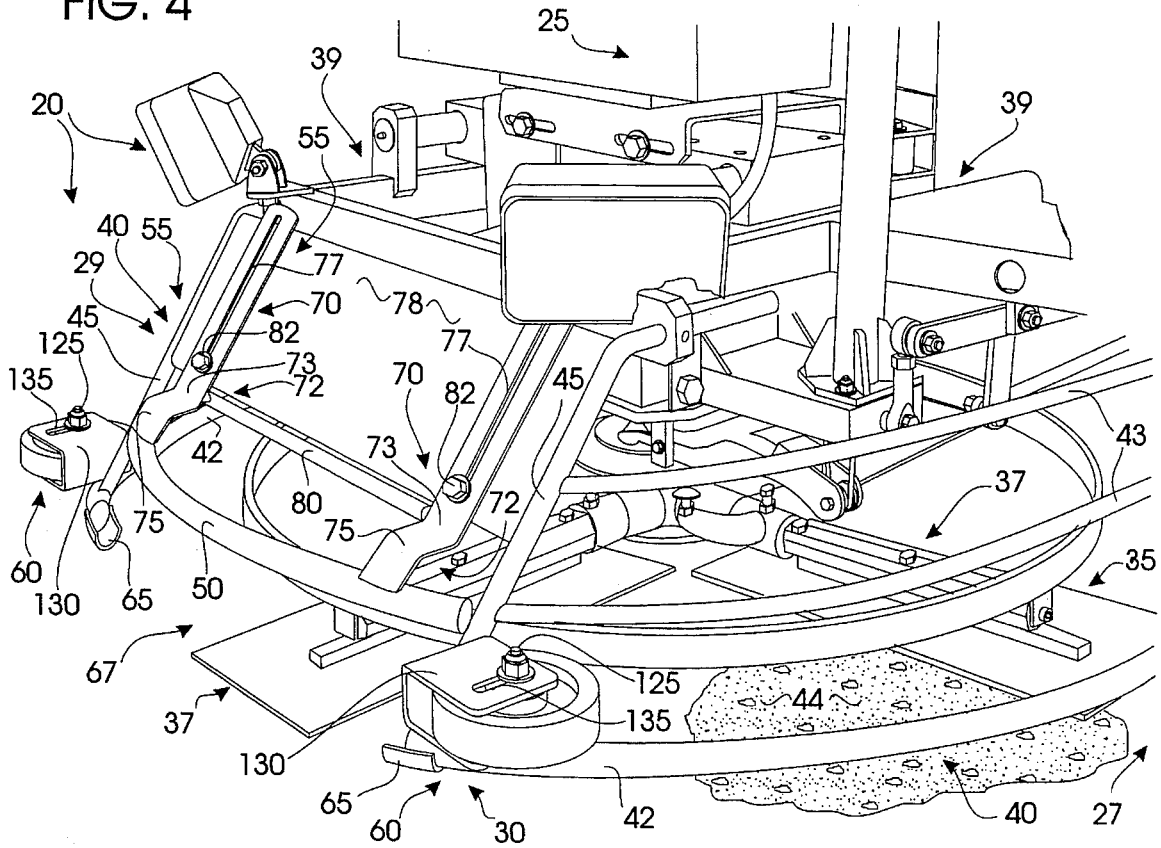
FIG. 4 is an enlarged partially fragmented front isometric view of the manual embodiment of my clearance system with the arc retracted.
Figure 5:
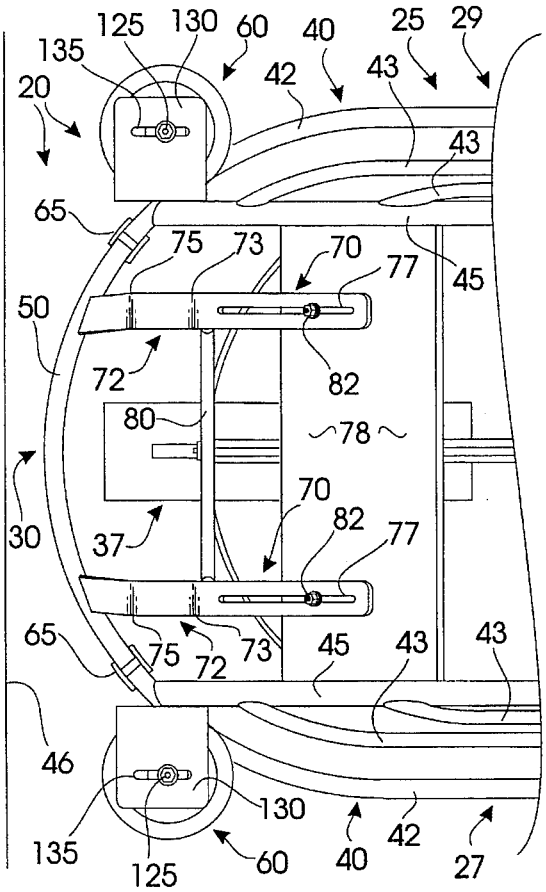
FIG. 5 is a fragmented top plan, environmental view of the manual embodiment of my clearance system with the arc deployed.

The displaceable coupling 55 may be either manual or electromechanical. The manual coupling embodiment 55 disclosed in FIGS. 1 through 8. The manual coupling 55 comprises a pair of spaced apart brackets 70. Each of the brackets has an offset 72 defined by a pair of bends 73, 75 to facilitate retraction of the arc 50 without interference by other cage elements. The brackets 70 define longitudinal slots 77 which index with threaded orifices defined in a cage frame member. This cage frame member is a generally rectangular header 78 spanning two spokes 45 of the frame cage 40. The header 78 provides rigidity to the cage 40 allowing the use of a movable arc 50. Preferably, a crossmember 80 extends between the brackets 70. This crossmember 80 provides rigidity to the arc 50 and coupling system 55. The arc 50 is held in place by bolts 82 passing through the longitudinal slots 77. The bolts are secured in the header's threaded orifices. The arc 50 is displaced by loosening the bolts 82 and sliding the arc 50 upwardly and inwardly, with the bracket slots 77 following the bolts 82. The bolts 82 are retightened to maintain the arc 50 in the retracted position (FIG. 4).

Figure 10:
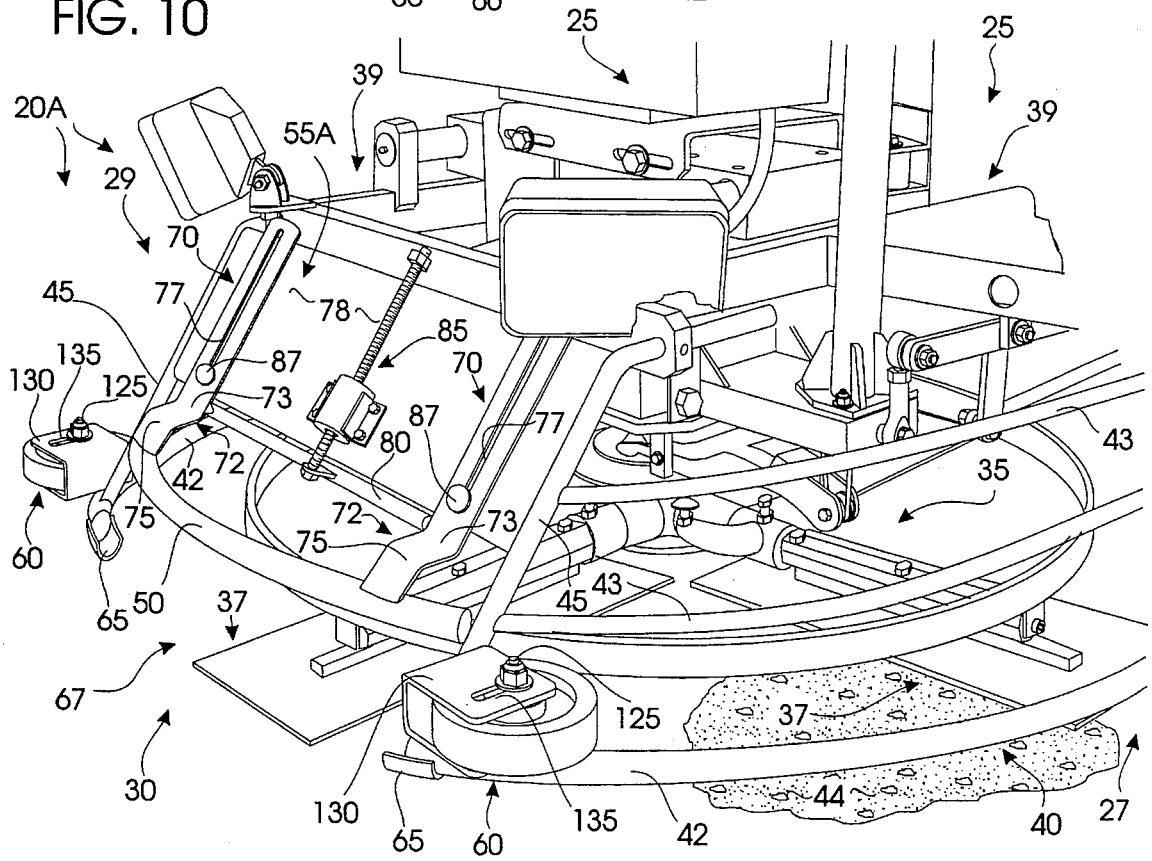
FIG. 10 is a partially fragmented front isometric view of the first electromechanical embodiment of my clearance system with the arc retracted.
Figure 11:
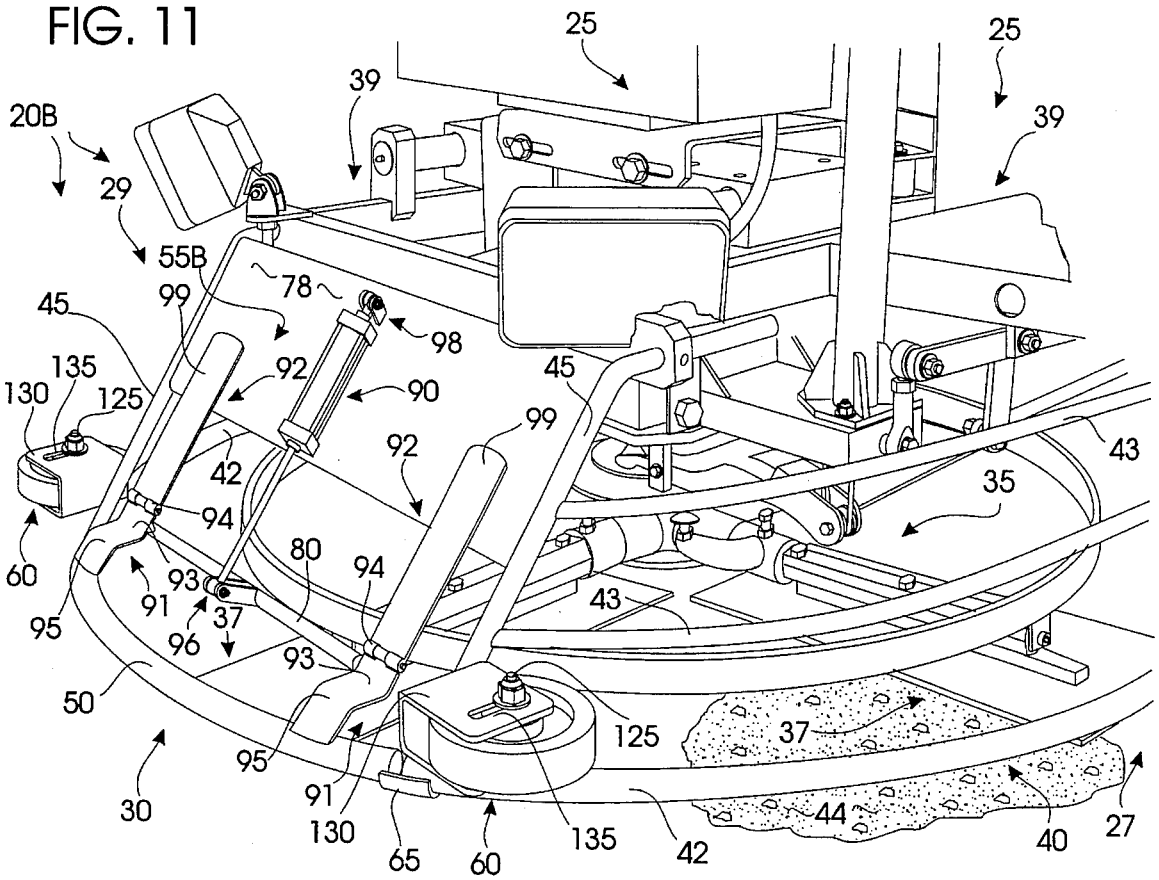
FIG. 11 is a partially fragmented front isometric view of the second electromechanical embodiment of my clearance system with the arc deployed.

Three electromechanical embodiments 20A, 20B and 20C of the present invention are illustrated in FIGS. 9 through 14. Each embodiment 20A, 20B and 20C employs an electromechanically operated displaceable coupling 55A, 55B and 55C, respectively. The first electromechanical embodiment 20A (FIG. 9 and 10) employs an electrically driven screw jack 85 as the displaceable coupling 55A. The screw jack 85 is interconnected between the header 78 and the crossmember 80 to deploy the arc 50. The bolts 82 retaining the brackets 70 to the header 78 are replaced with brads or carriage bolts 87. The brads 87 allow sliding movement of the brackets 70. They may also employ a nylon bushing or the like to ease movement. As the screw jack 85 is activated, the arc 50 is withdrawn similar to the manual system described above. Once the arc 50 is sufficiently withdrawn, the screw jack 85 is disengaged and holds the arc 50 in place (FIG. 10). To redeploy the arc 50, the screw jack 85 is reversed until the arc 50 again contacts the cradles 65 extending from the cage's lower ring 42.

Figure 12:
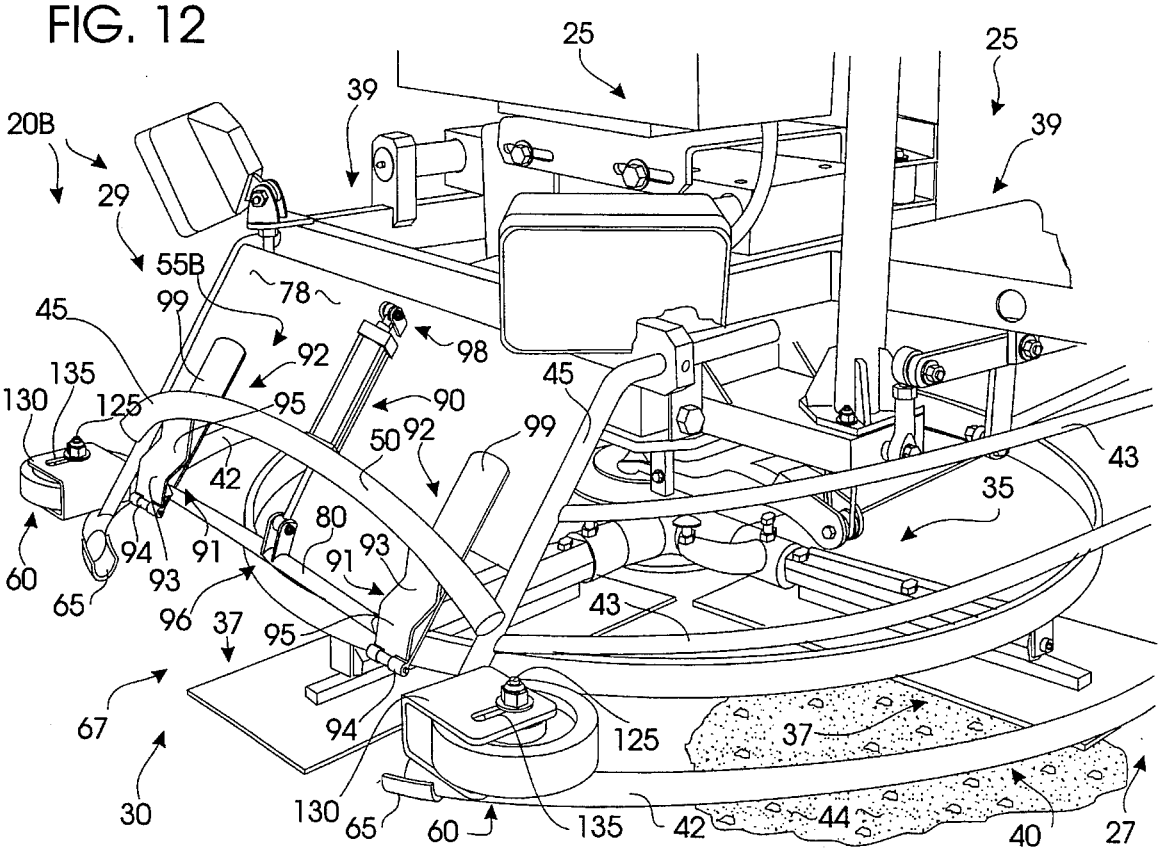
FIG. 12 is a partially fragmented front isometric view of the second electromechanical embodiment of my clearance system with the arc retracted.
Figure 13:
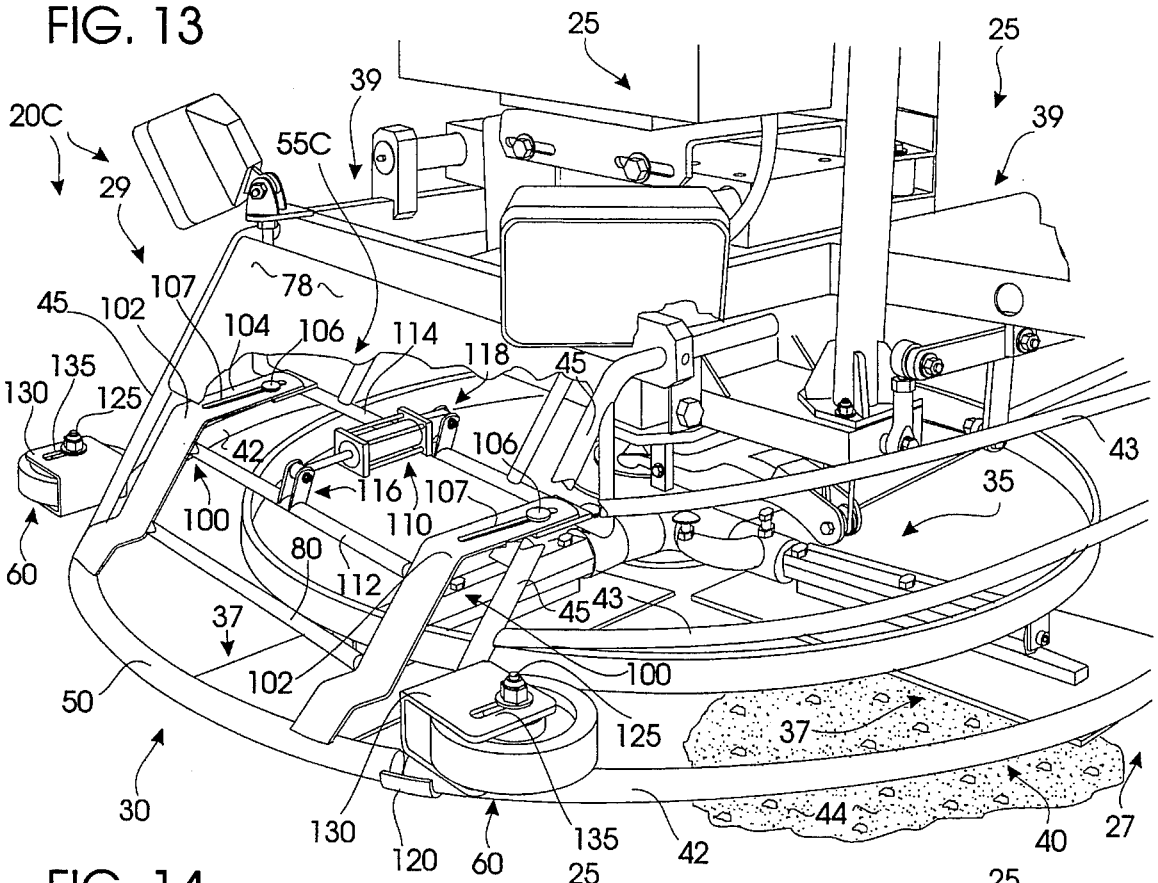
FIG. 13 is a partially fragmented front isometric view of the third electromechanical embodiment my clearance system with the arc deployed; and, FIG. 14 is a partially fragmented front isometric view of the third electromechanical embodiment of my clearance system with the arc retracted.

The second electromechanical embodiment 20B (FIG. 11 and 12) employs a hydraulic/pneumatic cylinder 90 or some other type of reciprocating device, such as an electrical solenoid, to actuate the displaceable coupling 55B. In this system, the brackets 92 are fixed to the header 78 and hinges 94 are defined in the brackets 92 above the offset 91 defined by the bends 93, 95. The reciprocating device 90 is secured between a lower shackle 96 extending upwardly from the crossmember 80 and an upper shackle 98 secured to the header 78. Each of these connections is pinned to facilitate rotational movement. As the reciprocating device 90 contracts, the arc 50 rotates about the hinges 94 in the brackets 92. Once the arc 50 has reached its fully retracted position, the bracket offset 92 contacts the upper portion 99 of the brackets 90 (FIG. 12). Deployment is the reverse procedure. Again when the arc 50 is deployed, it contacts the cradles 65 extending from the lower ring 42.

Figure 14:
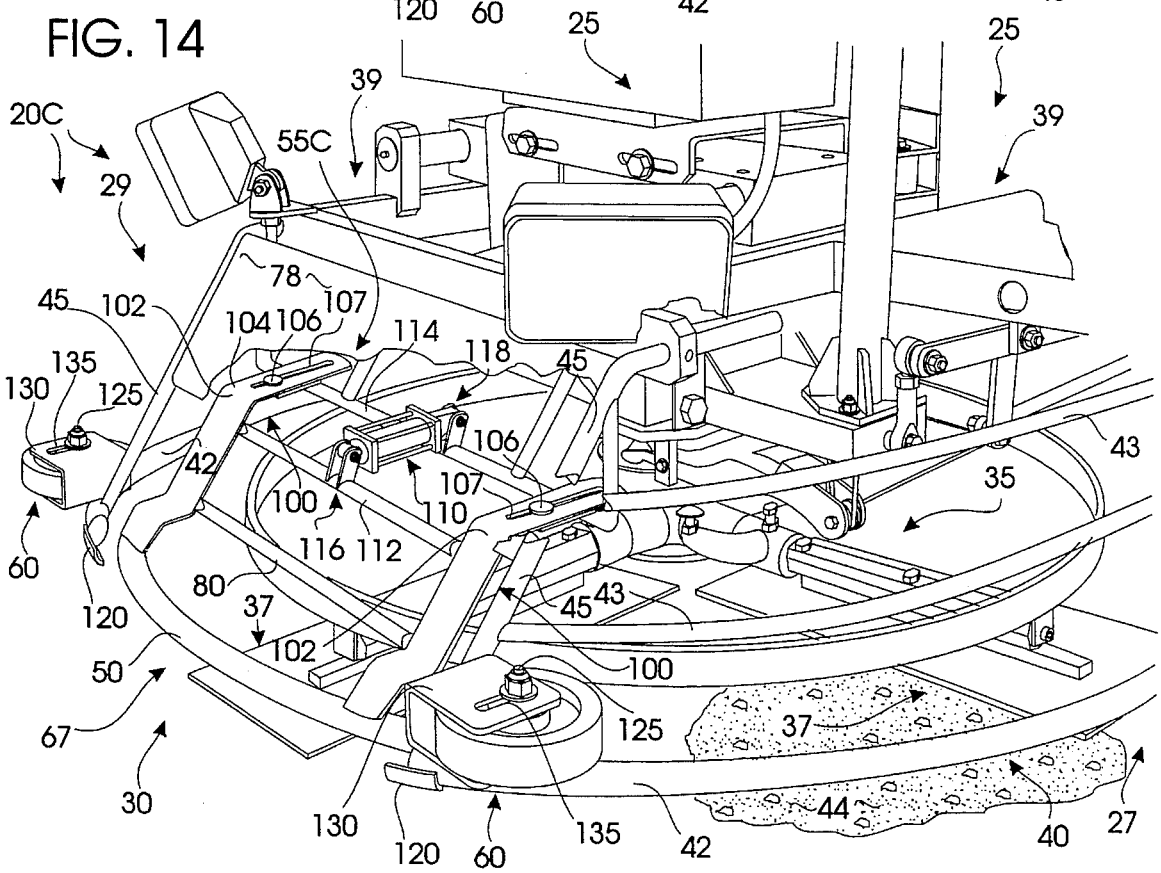

The third electromechanical system 20C (FIG. 13 and 14) also employs a reciprocating device 110 to actuate the displaceable coupling 55C. Brackets 100 have a third bend 102 orienting the inner portion of the brackets 104 generally horizontally. A pair of guides 106 index with the slots 107 in the brackets 100. The arc 50 is withdrawn into the frame 39 during retraction by a reciprocating device 110. The reciprocating device 110 is pivotally secured between a second, upper crossmember 112 and an internal, cage crosspiece 114. The guides 106 extend from the same crosspiece 114. The reciprocating device 110 is pinned between shackles 116, 118 similar to the immediately previous, second electromechanical, embodiment. The arc 50 is displaced outwardly into contact with the cradles 120 during deployment. The cradles 120 in this electromechanical embodiment 20C are abbreviated so that the inner portion of the cradle 120 will receive the arc 50 as it approaches the outer ring 42 of the cage 40 (FIG. 14).

Figure 2:
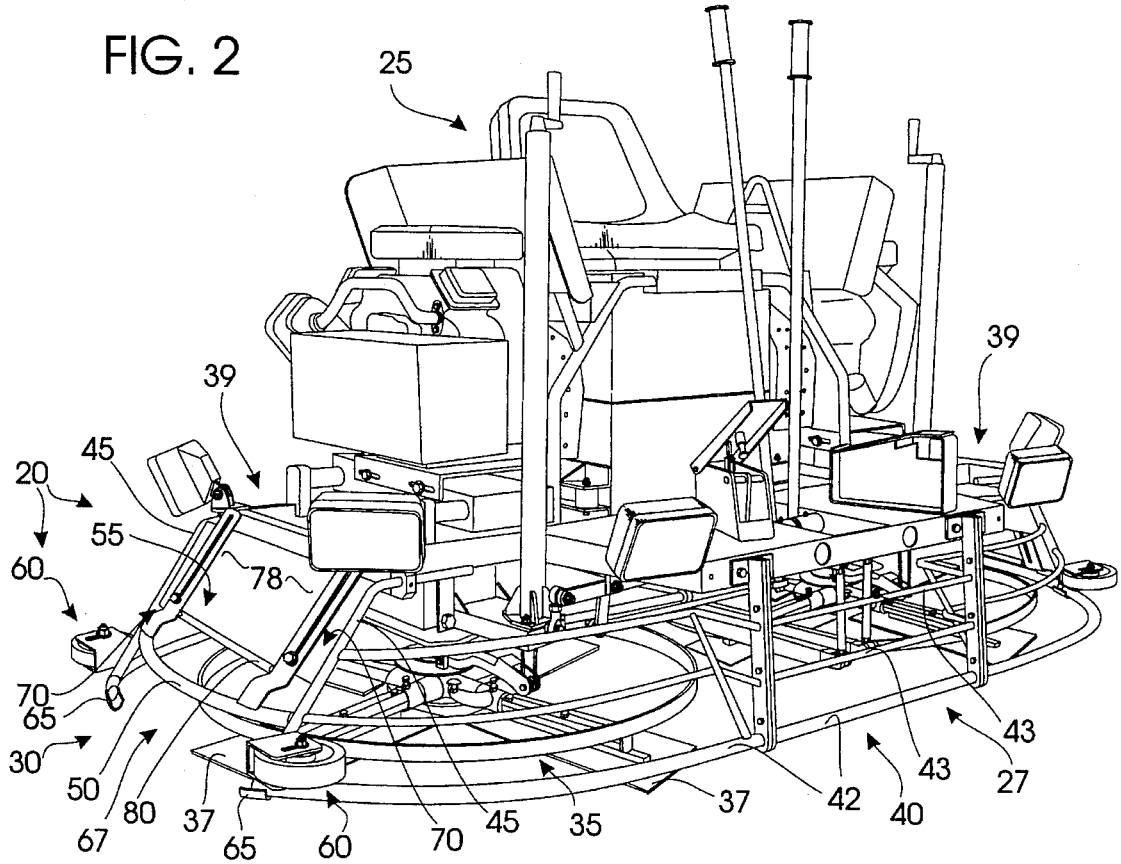
FIG. 2 is a front isometric view of the trowel of FIG. 1 with the arc retracted.
Figure 3:
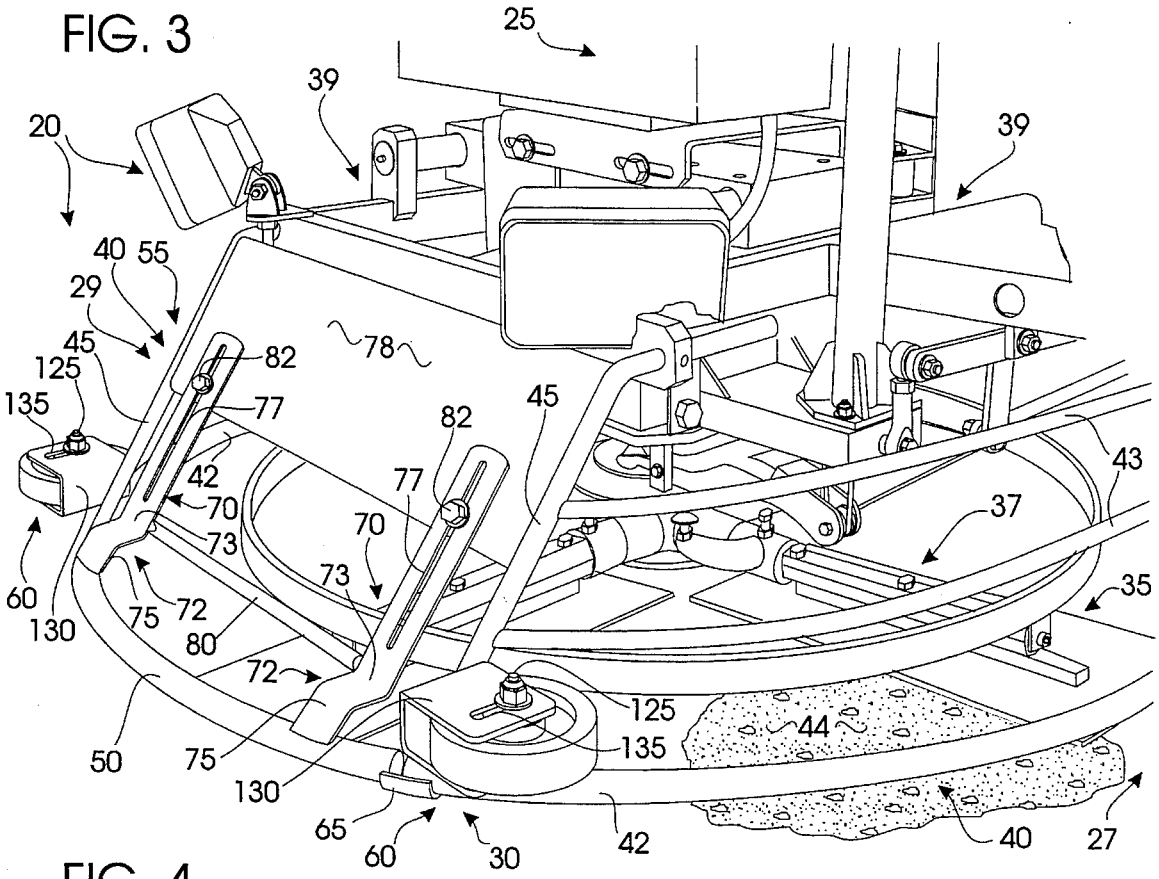
FIG. 3 is an enlarged partially fragmented front isometric view of the manual embodiment of my clearance system with the arc deployed.

The present system 20 also employs buffer wheels 60 mounted to the cage 40. These buffer wheels 60 are mounted on axles 125 within housings 130. The axles 125 are adjustable within slots 135 which are generally perpendicular to the direction of travel of the trowel 25. This adjustment allows the buffer wheels 60 to be moved outwardly to contact a wall 46 when the arc 50 is retracted. This facilitates finishing along the base of a wall 46. In other words, a trowel 25 can be held against the wall 46 with the buffer wheels 60 riding along the wall 46, insuring that the blades 37 will not strike the wall 46 and be damaged. Furthermore, the adjustability of the buffer wheels 60 allows the use of the present invention with varying widths of finishing rotor elements. For example, it might be desirous to place the present invention on an adjustable width riding trowel 25, as illustrated in FIGS. 1 and 2. This type of trowel 25 may employ either concrete finishing blades 37 or concrete finishing pans fitted on the blades 37. Therefore, it is necessary that the wheels 60 be adjustable to facilitate the proper spacing with the wall 46.

Operation

In operation the present device 20 is employed to finish concrete immediately adjacent an obstacle such as a wall 46, column, or curb. To finish the concrete immediately adjacent a column or curb, the arc 50 is retracted and the trowel 25 is moved as close as possible to the obstacle and the finishing is completed. Whenever a wall 46 is the obstacle, the buffer wheels 60 ride upon the wall, allowing finishing as close as possible to the wall 46 without damage to the wall or the finishing blades 37.

As a wall 46 is approached, the arc 50 is retracted. In the manual embodiment 20, the trowel 25 must be stopped and the bolts 82 retaining the arc 50 loosened. The arc 50 is then slid upwardly along the slots 77 in the brackets 70, and the bolts 82 are retightened. The buffer wheels 60 are adjusted to the proper position to facilitate contact with the wall 46 but to avoid blade contact with the wall 46. The trowel 25 is then restarted and driven along the wall 46. Contact between the wheels 60 and the wall 46 is maintained to properly finish the concrete along the base of the wall 46. To redeploy the arc 50, the trowel 25 is stopped and the bolts 82 are loosened. The arc 50 then slides down to contact the cradles 65. Last, the bolts are retightened to maintain the arc 50 in place.

In the electromechanical embodiments 20A, 20B or 20C the trowel 25 does not necessarily have to be stopped to retract the arc 50. However, it may need to be stopped if the buffer wheels 60 must be adjusted. A further alternative embodiment of the present invention calls for the buffer wheels 60 to also be electromechanically controlled. The electromechanical systems controlling the buffer wheels can also be interconnected to insure proper alignment of the wheels 60.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A motorized concrete riding trowel comprising:

a frame seating an operator;

a front, a rear, and spaced apart ends;

one or more finishing blades projecting from said frame adapted to contact and finish concrete;

a guard cage mounted to said frame and disposed about said finishing blades, said cage comprising a plurality of generally coaxial rings and a plurality of spaced apart spokes extending between said rings;

a clearance system adapted to maintain said trowel in a spaced apart relationship with a wall while allowing finishing of said concrete immediately adjacent said wall, said clearance system comprising:

arc means selectively displaceable between a deployed position mated to said cage means for guarding said blade means and a retracted position exposing at least a portion of said blade means;

coupling means for displacing said arc means between said deployed position and said retracted position, thereby establishing an unguarded cage segment allowing said finishing blades to be deployed immediately adjacent a wall; and, buffer means secured to said cage means for contacting said wall and allowing movement of said trowel along said wall while finishing said surface immediately adjacent said wall, said buffer means comprising wheels adjustably rotatably mounted in housings secured to and projecting outwardly from said cage means;

whereby said guard clearance system maintains said trowel in a spaced apart relationship with said wall while the trowel finishes the concrete surface immediately proximate said wall.

2. The riding trowel as defined in claim 1 wherein said coupling means comprises electromechanical means for displacing said arc means between said deployed and retracted positions.

3. The riding trowel as defined in claim 2 wherein said cage means comprises semicylindrical cradles that mate with said arc means when said arc means is deployed and release said arc means when ,said arc means is retracted.

4. The riding trowel as defined in claim 2 wherein said wheels are adjustable in a plane generally aligned with ends of said trowel and perpendicular to said wall to compensate said trowel for blade means of varying diameters.

5. The riding trowel as defined in claim 1 wherein said cage means comprises semicylindrical cradles that mate with said arc means when said arc means is deployed.

6. The riding trowel as defined in claim 1 wherein said coupling means comprises a pair of slidably adjustable brackets extending from said arc means for slidably displacing said arc means between said deployed and retracted positions.

7. The riding trowel as defined in claim 6 wherein said coupling means comprises power means for displacing said slidable brackets.

8. The riding trowel as defined in claim 1 wherein said coupling means comprises a pair of foldable brackets extending from said arc means for displacing said arc means between said deployed and retracted positions.

9. The riding trowel as defined in claim 8 wherein said coupling means comprises power means for displacing said foldable brackets.

10. A self propelled motorized riding trowel for finishing concrete, said system comprising:

downwardly projecting rotary blade means for contacting and finishing concrete;

cage means surrounding said trowel for guarding said blade means, said cage means comprising:

arc means selectively displaceable between a deployed position mated to said cage means for guarding said blade means and a retracted position exposing at least a portion of said blade means;

coupling means for displacing said arc means between said deployed position and said retracted position, thereby establishing an unguarded cage segment allowing said finishing blades to be deployed immediately adjacent a wall; and, buffer means comprising wheels adjustably rotatably mounted in housings secured to said cage means for contacting said wall and allowing movement of said trowel along said wall while finishing said surface immediately adjacent said wall;

whereby said guard clearance system maintains said trowel in a spaced apart relationship with said wall while the trowel finishes the concrete surface immediately proximate said wall.

11. The riding trowel as defined in claim 10 wherein said wheels are adjustable in a plane generally aligned with ends of said trowel and perpendicular to said wall to compensate said trowel for blade means of varying diameters.

12. A self propelled motorized riding trowel for finishing concrete, said system comprising:

downwardly projecting rotary blade means for contacting and finishing concrete;

cage means surrounding said trowel for guarding said blade means, said cage means comprising:

arc means selectively displaceable between a deployed position mated to said cage means for guarding said blade means and a retracted position exposing at least a portion of said blade means;

coupling means comprising a pair of foldable brackets extending from said arc means for displacing said arc means between said deployed and said retracted positions, thereby establishing an unguarded cage segment allowing said finishing blades to be deployed immediately adjacent a wall; and, buffer means secured to said cage means for contacting said wall and allowing movement of said trowel along said wall while finishing said surface immediately adjacent said wall;

whereby said guard clearance system maintains said trowel in a spaced apart relationship with said wall while the trowel finishes the concrete surface immediately proximate said wall.

13. The riding trowel as defined in claim 12 wherein said coupling means comprises power means for displacing said foldable brackets.

* * * * *